US011130667B2

(12) United States Patent
Becher et al.

(10) Patent No.: US 11,130,667 B2
(45) Date of Patent: Sep. 28, 2021

(54) DEVICE AND METHOD FOR FILLING A CONTAINER WITH A FILLING PRODUCT

(71) Applicant: KRONES AG, Neutraubling (DE)

(72) Inventors: Valentin Becher, Neutraubling (DE); Josef Knott, Neutraubling (DE); Florian Angerer, Neutraubling (DE); Ute Winter, Neutraubling (DE); Stefan Poeschl, Neutraubling (DE); Josef Doblinger, Neutraubling (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 16/644,138

(22) PCT Filed: Sep. 4, 2018

(86) PCT No.: PCT/EP2018/073666

§ 371 (c)(1),
(2) Date: Mar. 3, 2020

(87) PCT Pub. No.: WO2019/043237

PCT Pub. Date: Mar. 7, 2019

(65) Prior Publication Data

US 2020/0239295 A1 Jul. 30, 2020

(30) Foreign Application Priority Data

Sep. 4, 2017 (DE) ..... 10 2017 120 324.9

(51) Int. Cl.

| | |
|---|---|
| ***B67C 3/20*** | (2006.01) |
| ***B67C 3/28*** | (2006.01) |
| ***B67C 3/02*** | (2006.01) |
| *B67C 3/26* | (2006.01) |
| *B67C 7/00* | (2006.01) |

(52) U.S. Cl.

CPC ..... *B67C 3/208* (2013.01); *B67C 3/026* (2013.01); *B67C 3/202* (2013.01); *B67C 3/26* (2013.01); *B67C 3/28* (2013.01); *B67C 2007/006* (2013.01)

(58) Field of Classification Search

CPC ..... B67C 3/208; B67C 3/026; B67C 3/002; B67C 3/26; B67C 3/28; B67C 2007/006

See application file for complete search history.

(56) References Cited

U.S. PATENT DOCUMENTS

2011/0023994 A1* 2/2011 Meinzinger ..... B67C 3/023 141/1
2017/0158479 A1* 6/2017 Comin ..... B67C 3/26

FOREIGN PATENT DOCUMENTS

| | | |
|---|---|---|
| DE | 29518064 | 4/1997 |
| EP | 2272790 | 1/2011 |
| EP | 3178780 | 6/2017 |
| WO | WO 2010124766 | 11/2010 |

* cited by examiner

*Primary Examiner* — Jason K Niesz
(74) *Attorney, Agent, or Firm* — Haynes and Boone, LLP

(57) ABSTRACT

A device for filling a container with a filling product includes a filling valve for influencing the supply of the filling product into the container to be filled, generally during the transport, by means of a container transporting device, of the containers to be filled, a dosing valve for dosing a dosing product from a dosing product reservoir into the filling valve, and a main component reservoir for providing a main component at the filling valve. A dosing product changing device is provided for changing the dosing product in the dosing product reservoir during the filling operation.

19 Claims, 2 Drawing Sheets

DEVICE AND METHOD FOR FILLING A CONTAINER WITH A FILLING PRODUCT

CROSS REFERENCE TO RELATED APPLICATIONS

This application is a national stage of International Application No. PCT/EP2018/073666, filed Sep. 4, 2018, which claims priority from German Patent Application No. 10 2017 120 324.9 filed on Sep. 4, 2017 in the German Patent and Trademark Office, the disclosures of which are incorporated herein by reference in their entirety.

BACKGROUND

Technical Field

The present invention relates to a device and a method for filling a container with a filling product which is produced from at least a main component and a dosing product.

Related Art

In beverage bottling plants, it is known to produce the filling product to be filled into the respective containers from a main component and a dosing product. It is here known, for instance, to introduce water, for instance carbonized water, as the main component, via a filling valve, into the container to be filled. Prior to the container being filled with the main component, the dosing product is dosed via a dosing valve into the filling valve, so that, when the main component is filled into the container to be filled, the dosing product is flushed into the container with the flow of the main component and, at the same time, an intermixing takes place.

Accordingly, dual-component or multicomponent beverages, for instance beverages which are composed of a dosing product, for instance in the form of syrup, and of a main component, for instance in the form of water, can be produced in a flexible manner. In particular, in this configuration, upstream mixing devices, in which the filling product is mixed from the main component and the dosing product, can be dispensed with.

Such a device is known, for instance, from EP 2 272 790 A1.

For the production of multicomponent filling products, i.e., for instance, for the production of filling products which have a main component and two different dosing products, it is further known to provide, in addition to a first dosing valve, also a second dosing valve, which, in the manner already described, doses a second dosing product into the filling valve.

For a change of filling product, it may be necessary to change the dosing product. This is necessary, for instance, if after a first filling process with a first filling product, in case of a change of product, accordingly another filling product of different composition is due to be bottled on the respective filling device. To this end, it is necessary in the known devices to halt the filling process, to remove the current dosing product from the dosing product reservoir, and to flush the appropriate product lines, then fill the new dosing product into the dosing product reservoir and ensure that the new dosing product is present in the respective lines and is available at the dosing valve. Only then can the filling operation be resumed.

Accordingly, in the traditional devices and methods, it was necessary to halt the filling process for the change of dosing product.

SUMMARY

A device, and a method by means of which the bottling of filling products into containers can be performed with even greater efficiency is described according to various embodiments.

A device for filling a container with a filling product is described, including a filling valve for influencing the supply of the filling product into the container to be filled, for example during the transport, by means of a container transporting device, of the containers to be filled, a dosing valve for dosing a dosing product from a dosing product reservoir into the filling valve, and a main component reservoir for providing a main component at the filling valve. A dosing product changing device for changing the dosing product in the dosing product reservoir during the filling operation is provided.

Because a dosing product changing device for changing the dosing product in the dosing product reservoir during the filling operation is provided, it is possible, in the proposed device, to perform a change of dosing product in an efficient manner. In particular, it is herein possible to perform the change of dosing product without interrupting the filling operation.

The filling of the container to be filled generally takes place during the transport of the container to be filled. For this, a container transporting device, which, at least during the filling, transports the container to be filled along a transport path, is typically provided. In some embodiments, the container transporting device can be a rotary machine or a filler carousel, on which are disposed the filling valves, under which the containers to be filled are then arranged during the filling and which rotate jointly with the containers.

By a dosing product reservoir are understood all volumes in which the dosing product is received. This includes a dosing product vessel, as well as a dosing product line by means of which the dosing product is conducted from the dosing product vessel to the dosing valve.

For the changing of the dosing product in the filling operation, the current dosing product, both in a dosing product vessel and in the respective dosing product lines which transport the dosing product to the dosing valve, is accordingly ultimately replaced by the new dosing product. Hence a change of dosing product in the dosing product reservoir takes place, and the previous dosing product can be replaced by a new dosing product without having to interrupt the filling operation and, in particular, without having to perform a cleaning.

The dosing product changing device is generally set up to enable a changing of dosing product in the dosing product reservoir during a specific production phase in the bottling operation, for instance after the dosing product has been dosed into the filling valve, and/or after the container to be filled has been filled with the main component, and/or during a possible unloading of the container, and/or while the filling valve is closed.

The dosing product changing device can here cyclically undertake, for example upon each refilling of a container to be filled and respectively upon passage through the specific process phase, a further step for changing of the dosing product. In particular, it is not necessary to perform the complete change of dosing product in a single step, but rather the conclusion of the change of dosing product can be achieved over several cycles. Accordingly, the actual filling operation is not interrupted when the dosing product is changed—merely the dosing product which is present in the changing process cannot be used during the changing of the dosing product.

The changing can be performed in a particularly efficient manner if, in addition to a first dosing product reservoir and a first dosing valve, also at least a second dosing product reservoir and at least a second dosing valve are provided, and during the change of dosing product in the first dosing product reservoir, containers to be filled can be filled with the main component and with a dosing product from the second dosing product reservoir. If a filling product is produced, for instance, from a main component and two dosing products, then the changing of one of the dosing products can take place while the filling of the containers with a filling product including the other dosing product is continued.

During the production operation, a change of dosing product can however also be performed when, during the change of dosing product, the containers to be filled can be filled merely with the main component. More specifically, this might appear such that, when the dosing product is changed, for a certain period up to the completion of the change of dosing product through the filling valve, only the main component is bottled. As described above, the main component can be, for instance, carbonated water, i.e. mineral water. Hence, after the bottling of a filling product including both the main component and a first dosing product, a filling operation with only mineral water can firstly take place, during which the dosage changing device exchanges the dosing product, and then, once the change of dosing product has been made, a bottling of a further filling product consisting of the changed dosing product and the main component can take place.

The dosing product changing device is typically set up to set a differential pressure between the dosing product reservoir and the main component reservoir and, in some embodiments, is set up to make the pressure of the dosing product obtaining at the filling valve lower than the pressure of the main component obtaining at the filling valve, for changing of the dosing product.

Accordingly, during the ongoing filling operation, for instance with the filling valve closed, a differential pressure can be set by the dosing product changing device such that the pressure of the dosing product obtaining at the filling valve is lower than the pressure of the main component obtaining at the filling valve. Accordingly, the main component presses the dosing product, with opened dosing valve, back into the dosing product reservoir.

It is hence possible, by means of the main component, to press the dosing product back into the dosing product reservoir during the production operation, i.e. during the full filling operation, accordingly in those phases of the bottling process in which the filling valve is closed toward the container to be filled, in order to hence be able to conduct a changing of the dosing product after it has been successfully pressed back.

The forcing of the current dosing product back into the dosing product reservoir by means of the main component can be a forcing of the current dosing product back through the whole of the dosing product reservoir, so that the entire dosing product reservoir is at least at one point completely filled with the main component. In a further embodiment, the dosing product in the dosing product reservoir can, however, also be forced back only up to a predefined position, for instance up to a valve or a switchover device, so that in one portion of the dosing product reservoir dosing product, and in a further portion of the dosing product reservoir main component, is present. By means of the valve or the switchover device, a switch can then accordingly be made to the new dosing product, for instance by connection to a further dosing product vessel.

More specifically, this is achieved by a lowering of the pressure in the dosing product reservoir, so that the pressure of the dosing product obtaining at the filling valve is lower than the pressure of the main component obtaining at the filling valve. The pressure of the dosing product derives from that hydrostatic pressure of the dosing product that derives from the geometric arrangement of the dosing product reservoir or of the dosing product level within the dosing product reservoir above the filling valve, in combination with the pressure weighing on the dosing product in the dosing product reservoir, for instance gas pressure weighing on a dosing product vessel. The pressure of the main component obtaining at the filling valve likewise derives from the hydrostatic pressure of the main component reservoir or the geometric arrangement of the main component reservoir or of the main component level within the main component reservoir above the filling valve, in combination with the pressure weighing on the main component in the main component reservoir.

In a bottling device, only the pressure respectively weighing on the dosing product or the main component is able to be altered, whereas the geometry is usually fixed.

In order not to alter or influence the ongoing filling operation, the pressure of the main component at the filling valve is not altered by the dosing product changing device and, in particular, the differential pressure device. Accordingly, the filling operation can be continued with the parameters fundamental to the filling operation.

The differential pressure device of the dosing product changing device advantageously reduces the pressure in the dosing product reservoir, however, to such an extent that the pressure of the dosing product obtaining at the filling valve lies below the pressure of the main component at the filling valve, so that hence, when the dosing valve is switched, the main product presses the dosing product back into the dosing product reservoir.

Depending on the volumes for the dosing product which are to be displaced, the process of pressing the dosing product back from the dosing valve into the dosing product reservoir can be achieved in a single step, or in more than one step of the bottling process. The dosing product is typically pressed back whenever the filling valve is closed toward the container to be filled, i.e. for instance in the phases in which no container is present at the filling valve, in which a container to be filled has just been taken up, is evacuated, is flushed, is subjected to a pressurization gas, or, after the container to be filled has been filled with the filling product, and also in phases in which the container which is then filled with the filling product and which is still pretensioned to a higher pressure is depressurized to ambient pressure or is prepared to be discharged from the device.

Accordingly, the complete forcing back of the dosing product into the dosing product reservoir generally takes place cyclically, with the filling valve closed, and then typically also only in certain method phases, with the filling valve closed.

The dosing product changing device can additionally establish, for instance via a volume flow meter, whether the main component has already forced back the dosing product volume present in the dosing product reservoir, for instance from the dosing valve up to a dosing product vessel. As the volume flow meter, either a separate volume flow meter which is provided in the dosing product supply line, and/or else a volume flow meter, which measures the volume flow of the main component, can here be provided. Since the volume of the dosing product between the dosing valve or between the filling valve and the dosing product vessel is either definable in a geometrically simple manner, is measurable, or is known, it can accordingly be determined, by measuring the volume flow of the main product or of the dosing product, whether the dosing product has already been forced back fully into the dosing product reservoir or has been forced out of the dosing product reservoir.

If the dosing product has been fully pushed back, then only main component remains present in the dosing product line.

The dosing product changing device then conducts the actual change of dosing product, either by discharging the whole of the dosing product from the dosing product reservoir and introducing the new dosing product, or else by the dosing product changing device switching from one dosing product vessel to another dosing product vessel.

Subsequently, the dosing product changing device then conducts in reverse order the steps that, for instance, the pressure in the dosing product reservoir is increased to the point at which that pressure of the dosing product from the dosing product reservoir that obtains at the dosing valve is now again higher than the pressure of the main component obtaining at the filling valve. Accordingly, when the dosing valve is opened, the main component which remains present in the lines between the filling valve or dosing valve and the dosing product vessel can be pressed out of these lines, and here too it is again possible to establish, by means of the volume flow sensor, whether the main product has again been fully expelled from the lines and, accordingly, the new dosing product is available at the dosing valve.

The dosing product changing device, instead of providing the differential pressures, can also use a pump, by means of which the main component, with the dosing valve opened, can be pumped from the filling valve into the dosing product vessel and, following changing of the dosing product in the dosing product vessel or following switching to another dosing product vessel, can also assume the task of pumping out the main component to the point that the new dosing product is again available at the dosing valve.

In an alternative or additional configuration, the dosing product is fed to the respective dosing valves of the filling device via a ring line. The ring line forms, together with a dosing product vessel and possible supply lines, the dosing product reservoir.

In various embodiments, the dosing valves are here connected without dead space to the ring line. In another embodiment, the dosing valves are connected without dead space to the ring line via a shut-off valve, for example a block-and-bleed valve, so that a reliable and complete separation between ring line and dosing valve can also be conducted during the production operation.

The dosing product changing device then includes a circulating pump, by means of which the dosing product can be circulated in the ring line.

For the changing of the dosing product, all dosing valves are accordingly shut off, and then the dosing product present in the ring line is pressed, via the circulating pump and an appropriate supply of main product or of water or of the following dosing product, out of the ring line into the dosing product vessel. In other words, the dosing product in the dosing product reservoir is forced back by the feeding of a medium by means of the circulating pump, and hence the dosing product reservoir is at least partially emptied of the first dosing product and this dosing product is conducted back into a dosing product vessel.

The dosing product changing device then stops the circulating pump, so that the medium which has been used to empty the ring line as far as possible does not, or does not significantly, enter the dosing product vessel. It can here once again be established via a volume flow sensor whether the ring line is already completely filled with the medium.

If the ring line is emptied of the dosing product, then the dosing product changing device is set up to change the dosing product in the dosing product vessel, either by complete emptying of the dosing product reservoir and introduction of a new dosing product into the dosing product reservoir, or else by switchover from one dosing product vessel to a further dosing product vessel. The dosing product changing device then in turn switches the circulating pump such that the new dosing product is pressed into the ring line such that the medium which is at this point present in the ring line is displaced from the ring line.

In a further variant, in which a switch is made back-and-forth between two dosing product vessels, by means of the second dosing product from the second dosing product vessel, the first dosing product can also be displaced from the ring line and forced back into its dosing product vessel.

A method for filling a container with a filling product is described, including the influencing of the supply of the filling product, into the container to be filled, by means of a filling valve, for example during the transport of the container to be filled, the dosing of a dosing product, by means of a dosing valve, from a dosing product reservoir into the filling valve, and the provision of a main component at the filling valve from a main component reservoir. The dosing product in the dosing product reservoir is changed during the filling operation.

In this way, the advantages already described above with respect to the device can be achieved.

In several embodiments, the dosing product is changed during a production step, for example with the filling valve closed.

In an advantageous refinement, for the changing of the dosing product, the pressure in the dosing product reservoir is lowered and, with the filling valve closed and the dosing valve opened, the dosing product is at least partially forced back into the dosing product reservoir.

In certain embodiments, when the dosing product is forced back, the dosing product in the dosing product reservoir is exchanged, and then the pressure in the dosing product reservoir is increased again such that the pressure of the dosing product obtaining at the filling valve is higher than the pressure of the main component obtaining at the filling valve.

In several embodiments, the back-forcing of the dosing product by means of the main component is controlled with due regard to a flow meter.

In various embodiments, a circulating pump present in a ring line can in the method be switched to pump the dosing product out of the ring line, and to introduce the new dosing product.

In some embodiments, the dosing product is forced out of the ring line by means of another medium and by means of the circulating pump.

BRIEF DESCRIPTION OF THE FIGURES

Further embodiments of the invention are explained in greater detail by the following description of the figures.

DETAILED DESCRIPTION

Illustrative embodiments are described on the basis of the figures. Same, similar or like-acting elements are here provided in the different figures with identical reference symbols, and a repeated description of these elements is partially dispensed with in order to avoid redundancies.

Figure 1:
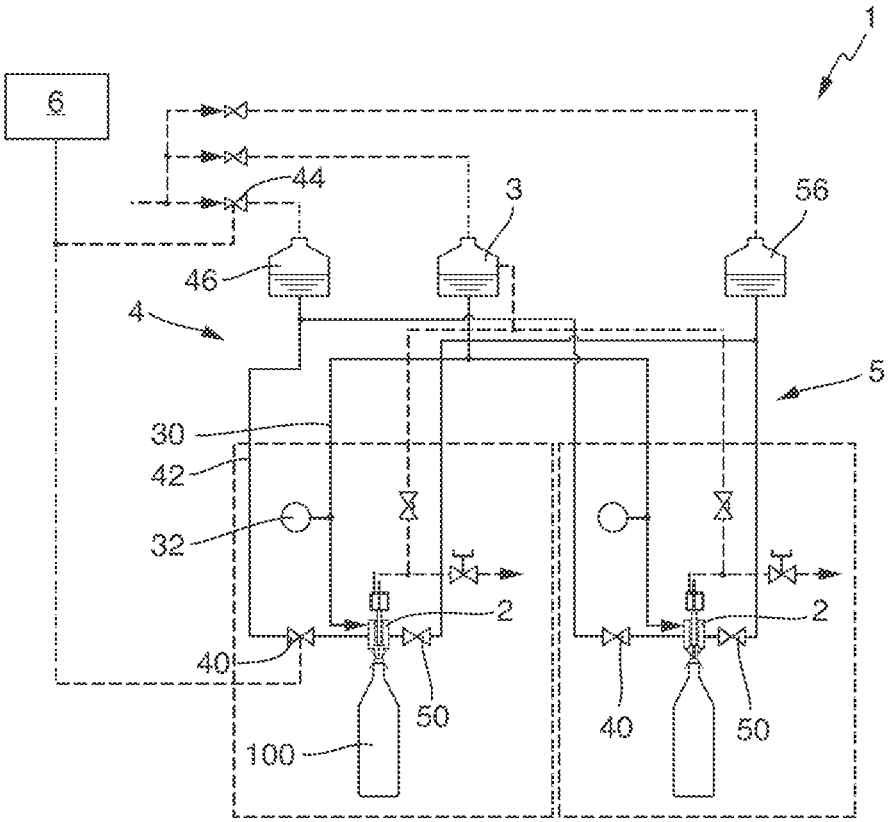
FIG. 1 shows schematically a device for filling a container with a filling product in a first illustrative embodiment.

In FIG. 1, a device 1 for filling a schematically shown container 100 with a filling product is shown. The containers 100 to be filled are arranged in the device 1 respectively beneath schematically indicated filling valves 2. Depending on the filling process, the containers 100 can here be pressed in a gastight manner against the filling valve 2, or the filling takes place in a free jet process. The filling of the containers 100 by means of the filling valves 2 here takes place during the transport of the containers 100. For this, the filling valves 2 are arranged, for instance, on the periphery of a filler carousel (not shown here), and the containers 100 to be filled are transported during the filling respectively under the filling valves 2.

The filling valves 2 serve to appropriately control the inflowing of the filling product which is intended to flow in a predefined volume, a predefined mass or at predefined fill height into the container 100 to be filled. In particular, the time of inflowing of the filling product into the container 100 to be filled and the end of filling is intended to be controlled in order to accordingly achieve a reliable bottling.

In this context, the term "controlling" also embraces a regulation of the flow of filling product into the container. In other words, the respective filling valve 2 influences the flow of the filling product into the container 100 respectively to be filled, such that the desired quantity of filling product is received in the container 100.

At the filling valve 2, the main component held in a main component reservoir 3 is supplied via a main component line 30. The main component held in the main component reservoir 3 is constituted, for instance, by water or carbonized water, which is pretreated in accordance with the specifications for the respective filling product.

The main component can be fed to the filling valve 2 via the main component supply line 30. A flow meter 32 for defining the volume flow of the main component is provided in order to ensure the inflowing volume of filling product during filling of the container 100 to be filled.

Besides the main component, a dosing product from a first dosing product reservoir 4 is fed to the filling valve 2, wherein a dosing valve 40 for dosing the dosing product into the filling valve 2 is provided. The dosing product is conducted from a dosing product vessel 46, through a dosing product line 42, up to the dosing valve 40. The dosing product line 42 and the dosing product vessel 46 respectively form parts of the dosing product reservoir 4, since they are filled with dosing product and accordingly hold this available for use by the dosing valve 40. All further components and volumes (not shown here) which conduct the dosing product to the dosing valve 40 are likewise part of the dosing product reservoir 4.

By means of the dosing valve 40, the dosing product present in the dosing product reservoir 4 can be fed to the filling valve 2, and the flow of the dosing product can be controlled via the dosing valve 40.

For filling of the container 100 with filling product, the dosing product from the dosing product reservoir 4 is firstly dosed, for instance, by means of the dosing valve 40, with the filling valve 2 closed, into the filling valve 2 or into a prechamber provided in the filling valve 2.

The volume of the dosing product dosed into the filling valve 2 can be defined, for instance, via the flow meter 32 arranged in the main component line 30, since, by dosing of the dosing product into the closed filling valve 2 or into its prechamber, the main component present in the filling valve 2 is forced back again into the main component line 30. Accordingly, the flow meter 32, during the dosing-in of the dosing product, registers a backflow, which, with the filling valve 2 closed, is identical to the quantity of dosing product dosed into the filling valve 2.

If the predefined quantity of dosing product is introduced into the filling valve 2, then the dosing valve 40 is closed and the filling valve 2 can be opened in order to flush the dosing product dosed into the filling valve 2, jointly with the main component, into the container 100 to be filled. The volume of liquid which is to be introduced into the container 100 to be filled can here likewise be defined via the flow meter 32, since the total volume flowing through the flow meter 32 corresponds to the volume flowing into the container 100. Once the provided filling volume is reached, then the filling valve 2 is closed again and a renewed dosage of the dosing product can take place into the closed filling valve 2 in order to prepare for the next filling process.

The same process can also be performed with a second dosing product, which is present in a second dosing product reservoir 5. Also, both dosing products can be introduced into the filling valve 2 in order to bottle a filling product including a plurality of dosing products and the main component.

If one of the dosing products, for instance the dosing product present in the dosing product reservoir 4, is now due to be changed in order to perform a change of product during the bottling operation, then, during the phases in which the filling valve 2 is closed, the dosing product is changed by means of a dosing product changing device 6. The dosing product changing device 6 here enables the dosing product in the dosing product reservoir 4 to be changed during the regular bottling operation.

For this, the dosing product changing device 6 is set up such that it enables the dosing product, starting from the filling valve 2 and the dosing valve 40, to flow back through the dosing product reservoir 4. The dosing product can here at least partially be forced back into the dosing product reservoir 4.

In order to achieve the backflow of the dosing product, the pressure which weighs on the dosing product in the dosing product reservoir 4, i.e., for instance, the pretensioning gas pressure, is lowered via the dosing product changing device 6, for instance, such that the pressure of the dosing products which obtains at the dosing valve 40 and at the filling valve 2 is lower than the pressure which, of the main component, obtains at the filling valve 2.

Accordingly, the dosing product changing device 6, for instance a pressurization gas valve 44 which controls or regulates the pressure in the dosing product reservoir 4, can switch such that the pressure for forcing the dosing product back into the dosing product reservoir 4 is lowered.

When the dosing product changing device 6 subsequently switches the dosing valve 40, with the filling valve 2 closed, then the main component, due to the now changed pressure relationships, will flow from the main product reservoir 3 in the direction of the dosing product reservoir 4. Accordingly, the main component continues to displace the dosing product present in the dosing product line 42 and dosing valve 40, until the main component has forced the dosing product fully back into the dosing product reservoir 4. The accordingly displaced volume is able to be defined via the volume flow meter 32, by means of which can be established whether the entire volume of the dosing product has already been pushed back into an upper part of the dosing product reservoir 4 and, in some embodiments, into the dosing product vessel.

If this is the case, either the dosing product in the dosing product reservoir 4 can be pumped off and replaced by a new one via the dosing product changing device 6, or else the dosing product changing device 6 can switch the dosing product vessel over to a further dosing product vessel (not shown here), which holds the new dosing product.

After this, the dosing product changing device 6 again increases the pressure within the dosing product reservoir 4 now including the new dosing product, such that the pressure obtaining at the dosing valve 40 or at the filling valve 2 is again higher than the pressure of the main component obtaining at the filling valve 2. Hence, when the dosing valve 40 is opened, the now new dosing product is conducted through the dosing product reservoir 4 and, in particular, from a dosing product vessel through the dosing product line 42 to the dosing valve 40 and, in the process, again displaces the main component from the dosing product line 42. With the filling valve 2 closed, it can here be established, likewise via the volume flow meter 32, whether this process is completed and whether the dosing product is again present directly at the dosing valve 40 or the filling valve 2.

This process of changing the dosing product respectively takes place in phases in which the filling valve 2 is closed. The changing of the dosing product also takes place in more than one step, which respectively take place with the filling valve 2 closed.

In this way, a changing of the dosing product during the ongoing bottling operation is able to be achieved, wherein during the filling operation, as the first dosing product is being changed, either no dosing at all of dosing product into the containers 100 to be filled then takes place, and accordingly, for instance, a bottling of carbonized mineral water as the main component takes place, or else a bottling of filling product in a combination of the second dosing product from the second dosing product reservoir 5 and the main component takes place.

In any event, the filling operation does not have to be interrupted and the plant can continue to bottle filling product, while, at the same time, a complete changing of the dosing product in the first dosing product reservoir 4 is performed.

For the changing of the dosing product, the dosing product changing device 6 here opens the dosing valve 40 when the pressure relationships necessary for changing the dosing product obtain or, alternatively, if an appropriate pump is present, when the changing of the dosing product does not collide with the further bottling process. This is in particular always the case when the filling valve 2 is closed, for instance because a new container is taken up, because no container is present, because the container is being pretreated, for instance by evacuation or pretensioning or flushing with a flushing gas, or because the filled container is decompressed and brought to ambient pressure, or because the container is prepared for transfer to a following transport device.

Figure 2:
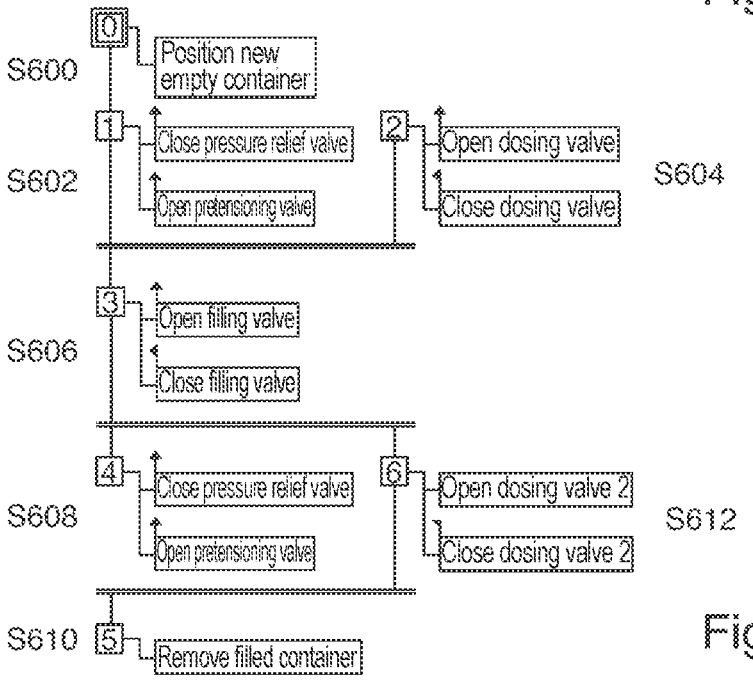
FIG. 2 shows a schematic representation of the bottling process.

This is shown schematically in the flow chart of FIG. 2. The parallelly running steps of the bottling and of the changing of the dosing product are shown in this chart.

In a first step S600, the new container 100 to be treated or filled is firstly positioned under the filling valve 2 and prepared for filling. Then, in step S602, the container 100 is pretensioned with a pressurization gas. During this pretensioning process, in parallel therewith, in step S604, a dosing of a dosing product into the closed filling valve 2 can be achieved by opening of the appropriate dosing valve 50. As soon as the intended dosing quantity is reached, the dosing valve 50 is closed again.

In step S606 the filling valve 2 is then opened, and the container to be filled is filled, in step S606, with the filling product consisting of the dosing product, which already in step S604 has been dosed into the filling valve 2, and the main component, which, by opening of the filling valve 2, flows in the wake of said dosing product.

After the end of the filling has been reached, which is defined, for instance, by the attainment of a filling volume monitored by means of the volume flow meter 32, the filling valve 2 is closed again.

Subsequently in step S608, with the filling valve 2 closed, the container, which is then filled with the filling product and which is under pressure due to its pretensioning and due to the fed-in filling product, is decompressed to ambient pressure.

In step S610, the container which has been filled and decompressed to ambient pressure can then be released from the filling process and fed to a further treatment process, for instance a closure.

Parallel to the decompression, in step S612, with the filling valve 2 closed, the dosing valve 40 can now be opened after the dosing product changing device 6 has set the dosing product reservoir 4 to a lower pressure than the pressure of the main component obtaining at the filling valve 2, so that, at this point and, for instance, parallel to step S608, the main component, by way of the dosing valve 40, forces the filling product present in the dosing product line 42 back into the dosing product reservoir 4.

This back-forcing in step S612 can take place parallel to the decompression of the container in step S608, and also parallel to the step of removing the filled container in step S610.

The dosing valve 40 is then closed again as soon as a renewed dosing of dosing product into the filling valve 2 commences via the other dosing valve 50.

Equally, when the dosing product changing device 6 has set the pressure in the dosing product reservoir 4 again sufficiently high that dosing product can flow out of the dosing product reservoir 4 in the direction of the dosing valve 40, in step S612 the main component can be forced back out of the dosing product line 42, and hence the dosing product line 42 can be filled with the then changed dosing product.

Accordingly, the changing of the dosing product by means of the dosing product changing device 6 can take place during the full-scale operation of the device 1 and takes place cyclically, respectively in phases in which the filling valve 2 is closed.

Figure 3:
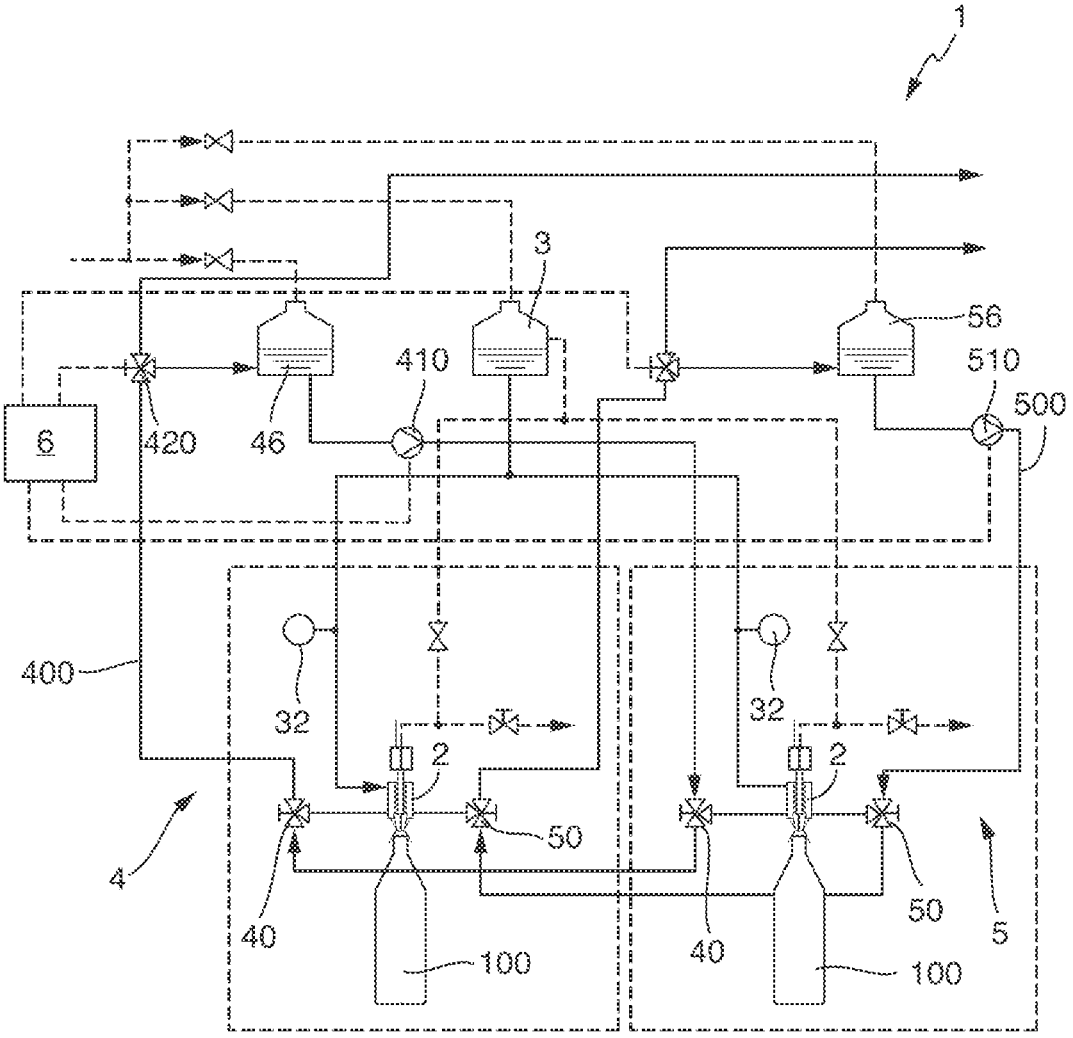
FIG. 3 shows a schematic representation of a device for filling a container in a second illustrative embodiment.

In FIG. 3, a further device 1 for filling schematically indicated containers 100 is shown, wherein a ring line 400 for the dosing product, in combination with a first dosing product vessel and possible supply lines, form the first dosing product reservoir 4, and a second ring line 500 for the dosing product, in combination with a second dosing product vessel and possible supply lines, form the second dosing product reservoir 5. The respective dosing valves 40, 50 are arranged, generally without dead space, on the respective ring line 400, 500.

The dosing product changing device 6 can here, via a circulating pump 410 or 510, achieve in the respective ring line 400, 500 a circulation of the dosing product volume present in the respective dosing product vessel.

Accordingly, for the changing of the dosing product by the dosing product changing device 6, it can be achieved that the dosing product is firstly conveyed from the respective dosing product vessel, by means of the circulating pump 410, through the ring line 400, such that the dosing product is directly available at the respective dosing valves 40, 50. The circulating pump 410 accordingly conveys the dosing product through the dosing product reservoir 4. During the production process, the circulating pump 410 does not need to be operated, but rather, due to the obtaining pressure relationships, the dosing product is subsequently delivered from the dosing product reservoir 4 to the dosing valve 40.

If now, via the dosing product changing device 6, a change of dosing product, for instance in the dosing product reservoir 4, is due to take place, then the dosing product reservoir 4 is emptied by means of the circulating pump 410, wherein the dosing product can be pumped off, for instance, via a corresponding dosing product changing valve 420.

If the dosing product vessel is completely emptied, then either water can be supplied in order to further flush out the ring line 400 by means of the circulating pump 410, or the new dosing product can be filled into the dosing product reservoir 4, which is then conveyed through the ring line 400 by means of the circulating pump 410 in such a way that the remaining previous dosing product present in the ring line 400 is likewise dispelled via the dosing product changing valve 420.

Accordingly, the result is that, after the changing of the dosing product and the operation of the circulating pump 410, the ring line 400 is completely filled with the new dosing product by means of the dosing product changing device-6.

In both said procedures, it is achieved that the current dosing product does not need to be discarded, but rather, during the bottling operation, can be completely removed from the system by being discarded either with the main component, with water or with the following dosing product.

Subsequently, the new dosing product is then fully available again, so that a production operation does not need to be interrupted and, at the same time, an efficient use of the dosing product takes place.

Where applicable, all individual features which are represented in the illustrative embodiments can be mutually combined and/or exchanged without departing from the scope of the invention.

The invention claimed is:

1. A device for filling a container with a filling product, comprising:

a filling valve configured to control a supply of the filling product into the container;

a dosing valve configured to dose a dosing product from a dosing product reservoir into the filling valve;

a component reservoir configured to provide a component at the filling valve; and a dosing product changing device configured to change the dosing product in the dosing product reservoir during a filling operation, wherein the dosing product changing device comprises a pressurization gas valve that controls a pressure in the dosing product reservoir.

2. The device of claim 1, wherein the dosing product changing device is configured to change the dosing product in the dosing product reservoir while the filling valve is closed.

3. The device of claim 1, further comprising a flow meter, and wherein the dosing product changing device is configured to switch an opening or a closing of the dosing valve based on a measurement of a flow of the component through the flow meter.

4. The device of claim 1, wherein the dosing product changing device is configured to set a differential pressure between the dosing product reservoir and the component.

5. The device of claim 4, wherein the dosing product changing device is configured to make a pressure of the dosing product obtained at the filling valve lower than a pressure of the component obtained at the filling valve.

6. The device of claim 1, further comprising a container transporting device configured to transport the container along a transport path, and wherein the filling valve is disposed on the container transporting device.

7. The device of claim 6, wherein the container transporting device comprises a rotary machine or a filler carousel.

8. The device of claim 1, wherein the filling valve comprises at least two filling valves, the dosing valve comprises at least two dosing valves, and the at least two dosing valves are connected to the dosing product reservoir via a ring line.

9. The device of claim 8, wherein the ring line comprises a circulating pump and the dosing product changing device is configured to switch the circulating pump to change the dosing product in the dosing product reservoir.

10. The device of claim 8, further comprising a dosing product changing valve, and wherein the dosing product changing device is further configured to switch the dosing product changing valve to discharge a current dosing product from the ring line.

11. A method for filling a container with a filling product, comprising:

controlling, by a filling valve, a supply of the filling product into the container;

dosing, by a dosing valve, a dosing product from a dosing product reservoir into the filling valve;

providing a component at the filling valve from a component reservoir; and changing, by a dosing product changing device, the dosing product in the dosing product reservoir during a filling operation, wherein the dosing product changing device comprises a pressurization gas valve that controls a pressure in the dosing product reservoir.

12. The method of claim 11, wherein the dosing product is changed while the filling valve is closed.

13. The method of claim 11, wherein changing the dosing product in the dosing product reservoir comprises lowering a pressure in the dosing product reservoir while the filling valve is closed and the dosing valve is opened such that the dosing product is at least partially forced back into the dosing product reservoir.

14. The method of claim 13, further comprising:

measuring a flow of the component; and determining, based on the flow, whether the dosing product has been forced back fully into the dosing product reservoir.

15. The method of claim 14, further comprising:

exchanging the dosing product in the dosing product reservoir after the dosing product is fully forced back; and increasing a pressure in the dosing product reservoir such that a pressure of a new dosing product obtained at the filling valve is higher than a pressure of the component obtained at the filling valve.

16. The method of claim 11, further comprising connecting the dosing valve to the dosing product reservoir via a ring line and providing a circulation pump in the ring line.

17. The method of claim 16, further comprising switching the circulating pump to pump the dosing product out of the ring line and introducing a new dosing product.

18. The method of claim 17, further comprising supplying a medium at the circulating pump to pump the dosing product out of the ring line.

19. The method of claim 18, wherein the medium comprises the component or water.

* * * * *